US010916898B2

(12) United States Patent
Yau et al.

(10) Patent No.: US 10,916,898 B2
(45) Date of Patent: Feb. 9, 2021

(54) SAFETY SWITCH ARRANGEMENT FOR A PERSONAL CARE APPLIANCE

(71) Applicant: KONINKLIJKE PHILIPS N.V., Eindhoven (NL)

(72) Inventors: Kam Hing Yau, Eindhoven (NL); Marcel Hilco Zijlstra, Eindhoven (NL); Venkata Srinivas Kalyan Nemana, Eindhoven (NL); Frans Wiebe Rozeboom, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 269 days.

(21) Appl. No.: 16/086,644

(22) PCT Filed: Mar. 22, 2017

(86) PCT No.: PCT/EP2017/056803
§ 371 (c)(1),
(2) Date: Sep. 20, 2018

(87) PCT Pub. No.: WO2017/162728
PCT Pub. Date: Sep. 28, 2017

(65) Prior Publication Data

US 2020/0313368 A1 Oct. 1, 2020

(30) Foreign Application Priority Data

Mar. 22, 2016 (EP) ..... 16161550

(51) Int. Cl.
*H01R 13/70* (2006.01)
*H01R 13/447* (2006.01)
*H01R 13/713* (2006.01)

(52) U.S. Cl.
CPC ..... *H01R 13/701* (2013.01); *H01R 13/447* (2013.01); *H01R 13/713* (2013.01)

(58) Field of Classification Search
CPC ... H01R 13/701; H01R 13/447; H01R 13/713
USPC ..... 439/143
See application file for complete search history.

(56) References Cited

U.S. PATENT DOCUMENTS 3,257,599 A * 6/1966 Tolmie ..... B26B 19/00 320/115
5,256,953 A * 10/1993 Cimbal ..... B26B 19/38 320/111
5,487,877 A * 1/1996 Choi ..... A47K 5/00 222/192

(Continued)

FOREIGN PATENT DOCUMENTS

DE 3025159 A1 1/1982
DE 3535564 A1 5/1986

(Continued)

*Primary Examiner* — Alexander Gilman

(57) ABSTRACT

A safety switch arrangement for a power connector of a personal care appliance includes a housing with a power connector having a connector receptacle, an operating switch, and an actuator. The actuator is mounted to the housing and is moveable between first and second states. In the first state, the actuator enables operation of the personal care appliance and prevents contact with the connector receptacle, and in the second state, the actuator prevents operation of the personal care appliance and enables contact with the connector receptacle.

20 Claims, 7 Drawing Sheets

(56) References Cited

U.S. PATENT DOCUMENTS

| | | | | |
|---|---|---|---|---|
| 5,530,334 | A * | 6/1996 | Ramspeck | B26B 19/286 320/111 |
| 5,727,273 | A * | 3/1998 | Pai | A61C 17/16 15/22.1 |
| 6,530,793 | B2 * | 3/2003 | Eichhorn | H01R 29/00 439/218 |
| 7,489,952 | B2 * | 2/2009 | Simoes | H01R 31/06 320/112 |
| 7,696,728 | B2 * | 4/2010 | Cross | H02J 7/342 320/166 |
| 8,686,683 | B2 * | 4/2014 | Caskey | H02J 7/007 320/107 |

FOREIGN PATENT DOCUMENTS

| | | | |
|---|---|---|---|
| DE | 4309034 | A1 | 9/1994 |
| EP | 0471404 | A2 | 2/1992 |
| JP | 5772277 | A | 5/1982 |
| WO | 2006115757 | A1 | 11/2006 |

* cited by examiner

SAFETY SWITCH ARRANGEMENT FOR A PERSONAL CARE APPLIANCE

This application is the U.S. National Phase application under 35 U.S.C. § 371 of International Application No. PCT/EP2017/056803, filed on Mar. 22, 2017, which claims the benefit of European Application No. 16161550.5 filed on Mar. 22, 2016. These applications are hereby incorporated by reference herein.

FIELD OF THE INVENTION

The present disclosure relates to a safety switch arrangement for a power connector of a personal care appliance which is operable in a first state and in a second state, wherein an operation of the personal care appliance is enabled in the first state, and wherein an operation of the personal care appliance is prevented in the second state. The present disclosure further relates to a personal care appliance that is fitted with a respective safety switch arrangement.

More generally, the present disclosure relates to safety features for electrically powered personal care appliances, particularly for respective appliances that comprise a rechargeable battery unit. More particularly, in accordance with at least some embodiments as discussed herein, the present disclosure relates to a safety feature for a personal care appliance that is operable in a wet and moist environment.

In at least some embodiments, the present disclosure relates to grooming appliances, particularly to hair cutting appliances.

BACKGROUND OF THE INVENTION

DE 35 35 564 A1 discloses an electrical apparatus comprising a housing and a plug arrangement that is accommodated in the housing, wherein the plug arrangement is arranged to be extracted from the housing. Further, a plug housing is provided that is movably accommodated in the housing. Connector pins are mounted to the plug housing. The plug housing and the connector pins may be moved between an extracted position and a retracted position with respect to the housing by means of an operating element. Further, the connector pins are movable between an extracted position and a retracted position with respect to the plug housing by means of the operating element.

U.S. Pat. No. 5,530,334 A discloses an electrical appliance comprising a housing structure comprising a first housing part and a second housing part that are arranged for accommodating at least one rechargeable battery, and a connector plug reception unit that is arranged to enable an insertion of a connector plug only when the two housing portions are mounted to one another, thereby securing the housing structure when the at least one rechargeable battery is recharged via the inserted connector plug.

Personal care appliances are well known in the art and involve grooming appliances, but also cleaning appliances, skin treatment appliances, hair removal appliances, massage devices etc. Generally, personal care appliances perform a treatment or an operation to a human or animal body.

Hair cutting appliances and hair grooming appliances are well-known in the art and may comprise, for instance, shavers, trimmers, epilators, hair styling appliances, and combinations thereof. Typically, hair grooming appliances comprise an electric motor that is arranged to drive a cutting unit, for instance a blade set, so as to effect a hair cutting and/or hair grooming operation. More generally, hair cutting appliances may be also referred to as grooming appliances.

Personal care appliances involve appliances that require a permanent cable link via a mains plug or power plug. Appliances of that kind do not necessarily require an internal battery or storage unit. Other types of trimming or grooming appliances comprise a battery unit, particularly a rechargeable battery unit. Consequently, appliances of that kind are operable in a fashion independent of a mains supply which has the advantage that no cable or cord obstructs the operation or inhibits a free handling of the appliance. However, also battery powered or rechargeable cell powered appliances have to be recharged from time to time. Therefore, also battery powered appliances typically comprise a socket or receptacle for a connector plug of a power adaptor.

In recent years, it became more and more popular to use personal care appliances, particularly grooming appliances, in a wet or moist environment. This may for instance involve application cases such as total body grooming under the shower, wet shaving using an electric razor, etc.

Hence, for some applications, there may be a first state of operation including the treatment procedure, and a second state of operation, involving recharging an integrated battery or storage cell.

Personal care appliances, particularly hair grooming and hair cutting appliances, must fulfill relatively strict safety regulations, especially if they may be operated in wet or moist environments. For instance, reference is made to the international IEC standard 60335-2-8, particularly to clause 25.24 thereof. Accordingly, wet shavers shall not have an interconnection cord unless they cannot be operated when connected to the supply mains.

At least in some jurisdictions, these and other safety and/or functional regulations have to be complied with so as to obtain official sales approval/certification.

SUMMARY OF THE INVENTION

It is an object of the present disclosure to provide a safety switch arrangement for a power connector of a personal care appliance and a personal care appliance implementing such a safety switch arrangement that enables a safe use of the appliance, particularly in a wet or moist environment. Preferably, the safety switch arrangement prevents an undesired state of maloperation which might involve the risk of damages at the level of the appliance and, all the worse, the risk of operator injuries. Preferably, the safety switch arrangement is composed of a limited number of parts. More preferably, the safety switch arrangement can be manufactured and assembled with relatively little efforts. Further, it is desirable to provide a safety switch arrangement that is easy to operate and that is preferably arranged in a fail-safe or failure-proof fashion. This involves that the safety switch arrangement is preferably readily operable in an intuitive and easy-to-understand fashion.

In a first aspect of the present disclosure, a safety switch arrangement for a power connector of a personal care appliance is presented, the arrangement comprising:

a housing portion, a power connector unit comprising a connector receptacle, an operating switch, and an actuation portion, wherein the actuating portion is mounted to the housing portion and arranged to be moved between a first state and a second state, wherein the power connector unit is arranged at the housing portion, wherein the actuation portion, in a first state, enables an operation of the personal care appliance and prevents a contact with the connector receptacle, wherein the operating switch is switched on by the actuation portion in the first state, and wherein the actuation portion, in a second state, prevents an operation of the personal care appliance and enables a contact with the connector receptacle.

This aspect is based on the insight that the actuation portion may be arranged in such a way that both a power switch and a safety feature of the appliance may be operated when the actuation portion is actuated to be moved between the first state and the second state. Consequently, only a single actuation operation is necessary so as to operate the appliance either in an operating state (corresponding to the first state) or in a charging state (corresponding to the second state). Hence, one and the same unit, the actuation portion, may be used to establish, in the first state, an electrical contact via the operating switch and to mechanically block the connector receptacle in such a way that no connector plug may be inserted therein. In the second state, the same unit may enable an access to the connector receptacle, and may break the electrical contact.

The safety switch arrangement may be referred to as dual purpose switch arrangement. A single actuation element may be used to provide two fundamental functions of the appliance.

In other words, it is not necessary to provide a separate, distinct actuation element for the operating switch. The actuation portion forms a single dual purpose control element. The actuation portion is not arranged to merely enable a separate, subsequent activation of an additional operation control element, e.g. a power-on button, etc. This would require another operation control step for the user. Rather, the power on switch is integrated into the actuation portion. Hence, in terms of a switching state of the operator switch, the first state may also be referred to as power-on state, and the second state bay also be referred to as power-off state. Simultaneously, the operator switch is switched on and the safety feature (disabling the connector receptacle) is activated.

As used herein, the term housing portion relates to those components of the safety switch arrangement that are directly or mediately attached, particularly fixedly attached, to a treatment-side of the appliance in a fashion substantially non-movable with respect to an overall housing and/or or a frame of the appliance. Accordingly, the housing portion may be referred to as a generic term for those components of the safety switch arrangement with respect to which the actuation portion can be moved. Further, also the overall housing and/or a frame are assigned to the generic term housing portion. Hence, also the actuation portion may be understood as a generic term for those components of the safety switch arrangement that can be moved with respect to the housing portion.

In accordance with the above-described arrangement, an enhanced safety level and fail-safe operation may be achieved. The safety switch arrangement may be implemented with relatively little efforts. Only a limited number of parts is required. Further, no complicated sensors and/or actuators are required. Rather, a considerably simple mechanical solution can be achieved. Consequently, the safety switch arrangement is easy to manufacture and easy to assemble. This is particularly advantageous in low-end and mid-range markets that are cost-sensitive.

A personal care appliance that is fitted with a respective safety switch arrangement may be operated in wet or moist environments, wherein the safety switch arrangement ensures that either the appliance may be operated for grooming/cutting or that they appliance may be recharged and therefore connected to a supply mains.

In an exemplary embodiment of the arrangement, the actuation portion is secured in the second state when a connector plug engages the connector receptacle. Hence, the connector plug, when in the engaged state, prevents the actuation portion from a movement from the second state to the first state. As a result, the appliance cannot be switched on without removing the connector plug. Therefore, an operation and a potential risk of damages or even injuries resulting from an operation of the appliance in the recharging state may be avoided.

In another exemplary embodiment of the arrangement, a first contact element of the operating switch is attached to the housing portion, wherein a second contact element of the operating switch is attached to the actuation portion, wherein, in the first state of the actuation portion, the first contact element at the second contact element contact one another, and wherein, in the second state of the actuation portion, the first contact element and the second contact element are spaced away from one another. Consequently, the movement of the actuation portion between the first state and the second state also directly operates the operating switch. The operating switch may be also referred to as main switch of the appliance. Hence, when breaking the connection or removing the first contact element and the second contact element of the operating switch from one another, an operation of the appliance is reliably prevented. Needless to say, in the second state, a connection between the connector plug and a rechargeable battery or storage cell may be established so as to recharge the appliance.

In yet another exemplary embodiment of the arrangement, the second contact element forms part of a contact spring which is preferably arranged at a circumferential wall of the actuation portion. The contact spring may be arranged as a leaf spring. The contact spring may comprise two second contact elements at respective ends thereof. The two second contact elements may connect two respective first contact elements at the side of the operating switch which is attached to the housing portion.

In a further exemplary embodiment of the arrangement, the actuation portion is arranged to be rotated with respect to the housing portion, preferably about a longitudinal axis thereof, between the first state and the second state. Hence, by a relative rotation between the housing portion and the actuation portion, the appliance may be switched between the operating state and the charging state. Hence, a twisting action operates the actuation portion.

In a further exemplary embodiment of the arrangement, the actuation portion blocks the connector receptacle in the first state, wherein the actuation portion unlocks the connector receptacle in the second state. When the connector receptacle is locked in the first state, the connector plug cannot be inserted therein. When the connector receptacle is unlocked in the second state, the connector plug may be plugged in and pulled out. This is not allowed in the locked state.

In yet another exemplary embodiment of the arrangement, the actuation portion blocks an access for a connector plug to the connector receptacle in a first state, wherein the actuation portion enables an access for a connector plug to the connector receptacle in the second state. In yet another exemplary embodiment, the actuation portion at least partially covers an insertion recess of the connector receptacle in the first state.

As indicated above, the power connector unit including the connector receptacle is arranged at or attached to the housing portion. Therefore, when the actuation portion is moved, rotated or twisted with respect to the housing portion, also a relative movement with respect to the connector receptacle takes place. Hence, the actuation portion itself may at least partially block or obstruct the connector receptacle.

A further benefit of this exemplary arrangement is that the connector receptacle, particularly the insertion recess, may be considerably protected in the second state, even when no connector plug is attached, due to the shape of the actuation portion. Hence, the appliance may easily be kept in the second state (power off state), even when no recharging procedure is performed. In a further related exemplary embodiment, the connector receptacle does not comprise a component that is exposed or that protrudes beyond an overall housing of the appliance.

In a further exemplary embodiment, the actuation portion is, in the second state, arranged in a self-retention fashion. This involves that no reverse actuation of the actuation portion is possible. A reverse actuation may be for instance initiated by the connector plug when the connector plug is urged or forced into the connector receptacle when the actuation portion is in or close to the second state. Hence, the risk of maloperation or misuse is further reduced.

In yet another exemplary embodiment of the arrangement, the actuation portion is arranged as an extension of the housing portion, wherein the actuation portion is preferably arranged at a bottom end of the housing portion that is opposite to a top end which is arranged to receive a grooming unit, for instance a cutting unit. Hence, the overall housing of the appliance may have an integral and smooth design. Further, also the connector receptacle which is at least partially covered by the actuation portion may be arranged at the bottom end.

In yet another exemplary embodiment of the arrangement, the actuation portion comprises a circumferential extension substantially corresponding to a circumferential extension of the housing portion, at least in a contact area where the actuation portion and the housing portion contact one another. Hence, a smooth transition between the housing portion and the actuation portion may be achieved. Further, when viewed in a cross-sectional view perpendicular to the longitudinal axis, the extension of the profile of the actuation portion substantially corresponds to the extension of the profile of the housing portion, at least in a contact area therebetween.

In accordance with yet another exemplary embodiment of the arrangement, the actuation portion is arranged in a cup-like fashion, wherein an open end thereof faces the housing portion, wherein a bottom wall thereof faces away from the housing portion, wherein an insertion aperture is formed in the bottom wall, and wherein the insertion aperture defines an opening which is aligned with the connector receptacle in the second state of the actuation portion and which is misoriented with respect to the connector receptacle in the first state of the actuation portion.

Hence, the connector receptacle and the insertion aperture may be twisted with respect to one another, thereby changing the relative orientation therebetween. By way of example, the connector receptacle and the insertion aperture may be arranged at the longitudinal axis of the housing portion, wherein the actuation portion is arranged to be rotated about the longitudinal axis.

However, also alternative embodiments may be envisaged wherein the insertion aperture and the connector receptacle are not necessarily arranged at the longitudinal axis of the housing portion. Also if this is the case, a relative movement between the first state and the second state of the actuation portion may cause an alignment in the second state and a misalignment in the first state. The misalignment referred to herein is a defined and desired misalignment or misorientation. A misalignment or misorientation may involve that the insertion aperture of the actuation portion is skewed or rotated with respect to the connector receptacle and/or shifted away or displaced from the connector receptacle.

In still alternative embodiments, a rotation axis of the actuation portion is not aligned with the longitudinal axis of the housing portion. However, an alignment of the respective axes may be beneficial insofar as an overall outer contour or shape of the appliance is maintained, regardless of whether the actuation portion is in the first state or the second state.

In yet another exemplary embodiment of the arrangement, the actuation portion is provided with a gripping section comprising gripping features for handling and operating the actuation portion between the first state and the second state. The gripping features may for instance involve a knurling, serrations, non-round contours, angular contours, etc. Generally, the actuation portion facilitates handling and operating the appliance, particularly the actuation portion. A user readily may readily understand the purpose of the actuation portion when a gripping section including prominent gripping features is provided.

In yet another exemplary embodiment of the arrangement, the housing portion and the actuation portion comprise mounting features that enable a positive fit mounting, preferably a twist-lock mounting, of the actuation portion at the housing portion, and wherein the mounting feature preferably cooperates so as to define limit stops for the relative movement between the actuation portion and the housing portion. For instance, bayonet mounting features may be used which enable an axial approach of the actuation portion to the housing portion in a defined relative mounting orientation. When the axial approaching movement is accomplished, a rotating or twisting movement may follow.

Preferably, at least one resilient snap-on locking element is provided that secures the actuation portion and the housing portion in their engaged state, while still allowing for a defined relative movement therebetween. The resilient snap-on locking element may be for instance arranged as a deflectable wall or tab. The resilient snap-on locking element may on the one hand lock or secure the actuation portion and the housing portion in their mounted configuration. Further, the resilient snap-on locking element may define at least one limit stop for the relative movement of the actuation portion and the housing portion.

In an exemplary embodiment of the arrangement, the mounting features involve at least one circumferentially extending groove at the housing portion or the actuation portion which involves a frontal insertion opening, wherein a corresponding radially protruding tab or pin is provided at the other one of the housing portion and the actuation portion which is arranged to engage the groove. When the protruding pin or tab is arranged in the circumferentially extending section of the groove, a twisting relative movement between the actuation portion and the housing portion is enabled.

Further, so as to lock the housing portion and the actuation portion in their mounted state, a dead point may have to be surmounted when the actuation portion is rotated with respect to the housing portion. The dead point may be defined by the deflectable snap-on locking element. Hence, a contrary movement is prevented and, as a result, the deflectable snap-on locking element defines a limit stop for the relative movement between the actuation portion and the housing portion. Another limit stop may be defined by an end of the circumferentially extending groove which is remote from the insertion opening. In this way, a combined snap-on twist-lock or bayonet mounting may be achieved.

In yet another exemplary embodiment of the arrangement, the housing portion comprises a visual position reference, wherein the actuation portion comprises a visual position indicator, and wherein the position reference and the position indicator indicate whether the actuation portion is in the first state or the second state. This may further facilitate the operation of the appliance. Accordingly, the risk of maloperation may be further reduced.

In yet another exemplary embodiment of the arrangement, at least one resting element is provided for securing the relative position of the actuation portion with respect to the housing portion, at least in the first state. To this end, biasing elements, such as springs and such like may be used which may engage respective counterparts for temporary securing a defined relative position. Also for the second state, a resting element may be provided. However, when the connector plug is inserted in the connector receptacle in the second state, the connector plug itself secures and maintains the actuation portion in the second state. The actuation portion may be moved to the first state only when the connector plug is pulled out.

In a further aspect of the present disclosure, a personal care appliance, particularly a hair grooming appliance, is presented, the appliance comprising a housing arranged to receive a treatment unit, particularly a grooming unit, an effector unit, particularly a motor, disposed within the housing and a safety switch arrangement in accordance with at least one embodiment as disclosed herein, wherein, in the first state of the actuation portion, the appliance is operable for personal care treatment, and wherein, in the second state of the actuation portion, a personal care treatment operation of the appliance is prevented.

In an exemplary embodiment, the appliance further comprises a battery unit that is arranged to be recharged via the connector receptacle, wherein a treatment state of operation and a recharge state of operation are mutually exclusive, depending on the actual state of the actuation portion. The battery unit may be also referred to as accumulator, storage cell, and such like. In accordance with this embodiment, the appliance may be either operated in a treatment mode, particularly a hair grooming mode, or in a recharge mode. A combined hair treatment/recharging operation is prevented.

In yet another exemplary embodiment of the appliance, the power connector unit is arranged to be coupled with a power adaptor, the power adapter comprising a connector plug that is arranged to engage the connector receptacle exclusively in the second state of the actuation portion, and wherein the appliance is preferably arranged to operate in a wet or moist environment. Only in the second state of the actuation portion, the connector plug may be plugged in the power connector unit of the appliance.

BRIEF DESCRIPTION OF THE DRAWINGS

These and other aspects of the invention will be apparent from and elucidated with reference to the embodiments described hereinafter. In the following drawings.

DETAILED DESCRIPTION OF THE EMBODIMENTS

Major aspects and embodiments of the current disclosure will be described with reference to grooming appliances, particularly hair cutting appliances. However, this shall not be interpreted in a limiting way. Rather, aspects and embodiments of the current disclosure may be also implemented in non-grooming personal care appliances, wherein exemplary appliances will be described further below.

Figure 1:
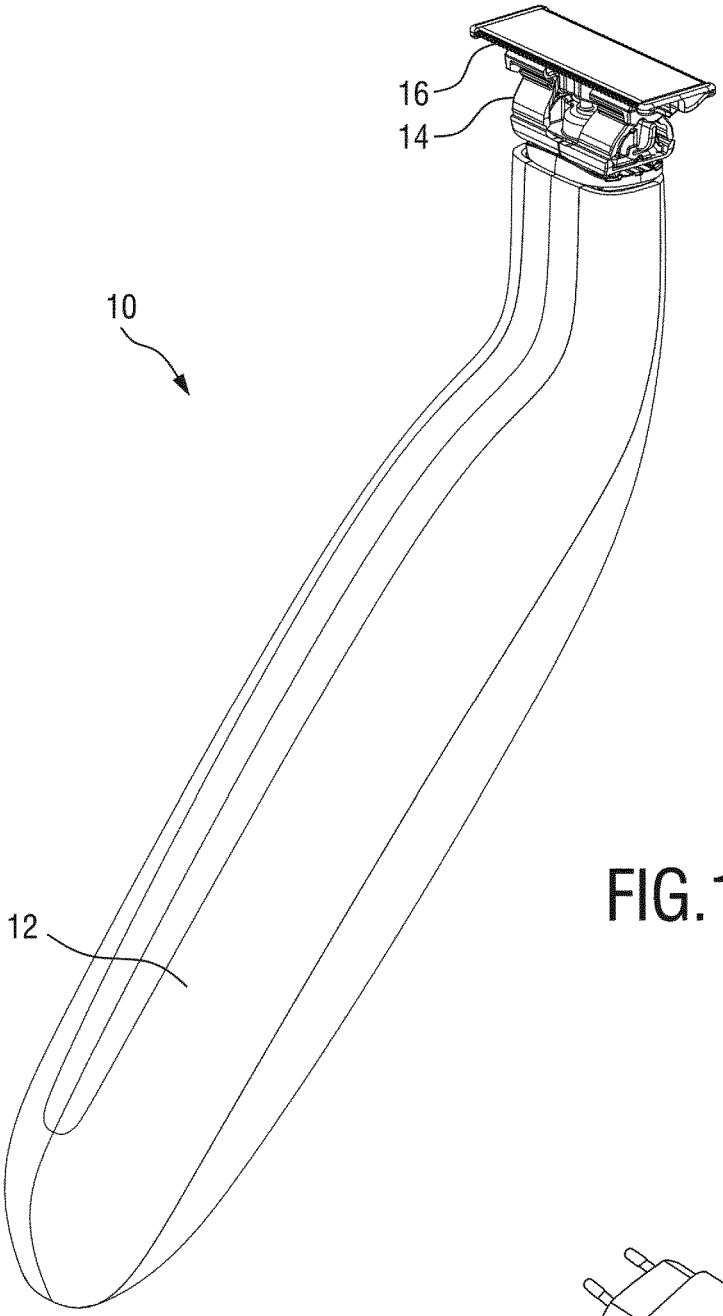
FIG. 1 shows a perspective view of a hair grooming appliance arranged as a combined trimming/shaving appliance.

FIG. 1 shows in a perspective top view an exemplary arrangement of a grooming appliance 10 which is arranged as a hair cutting appliance, primarily for illustrative purposes. Hair cutting appliances generally involve hair trimmers, shavers and combined devices. The appliance 10 of FIG. 1 is arranged for both trimming and shaving. The appliance 10 involves an elongated housing 12. At a first, top end of the housing 12, a grooming unit 14 arranged as a cutting unit may be received. The cutting unit comprises a blade set 16. The cutting unit, particularly the blade set 16 may be operated so as to effect a cutting action. In alternative embodiments, the grooming unit 14 may be arranged as an epilator unit, for instance. As indicated above, the appliance 10 may be arranged as a battery powered appliance or as a cable powered appliance.

Figure 2:
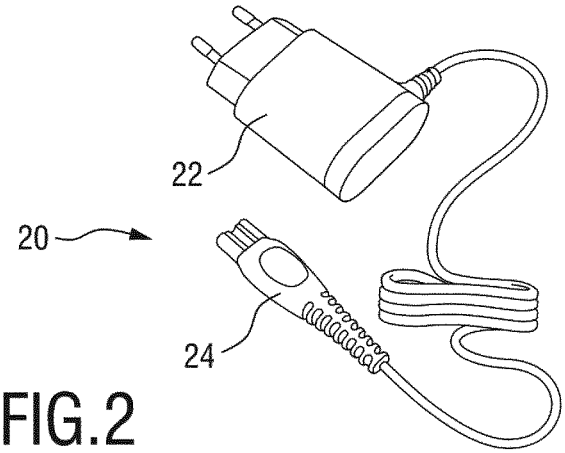
FIG. 2 shows a schematic perspective view of a power adapter for recharging a hair grooming appliance.

At least in some embodiments, the appliance 10 as shown in FIG. 1 may be equipped with a power adapter 20 as schematically shown in FIG. 2. The power adapter 20 comprises a power plug 22 at a first end thereof, and a connector plug 24 at a second end thereof. The power plug 22 is arranged to contact a mains supply. The connector plug 24 is arranged to engage a respective receptacle at the appliance 10, particularly at a bottom end of the housing 12 thereof that is opposite to the first end to which the grooming unit 14 is attached.

In at least some exemplary arrangements of hair cutting appliances 10 as shown herein, the grooming unit 14 is arranged as a detachable or replaceable grooming unit 14. Consequently, for illustrative purposes, in the following figures no explicit representation of the cutting unit 14 is provided. The same applies to the power adapter 20 which is provided for illustrative purposes in FIG. 2.

In some embodiments, when the appliances discussed herein are not necessarily arranged as hair cutting appliances, the grooming/cutting unit may be referred to as treatment unit or treatment head.

Figure 3:
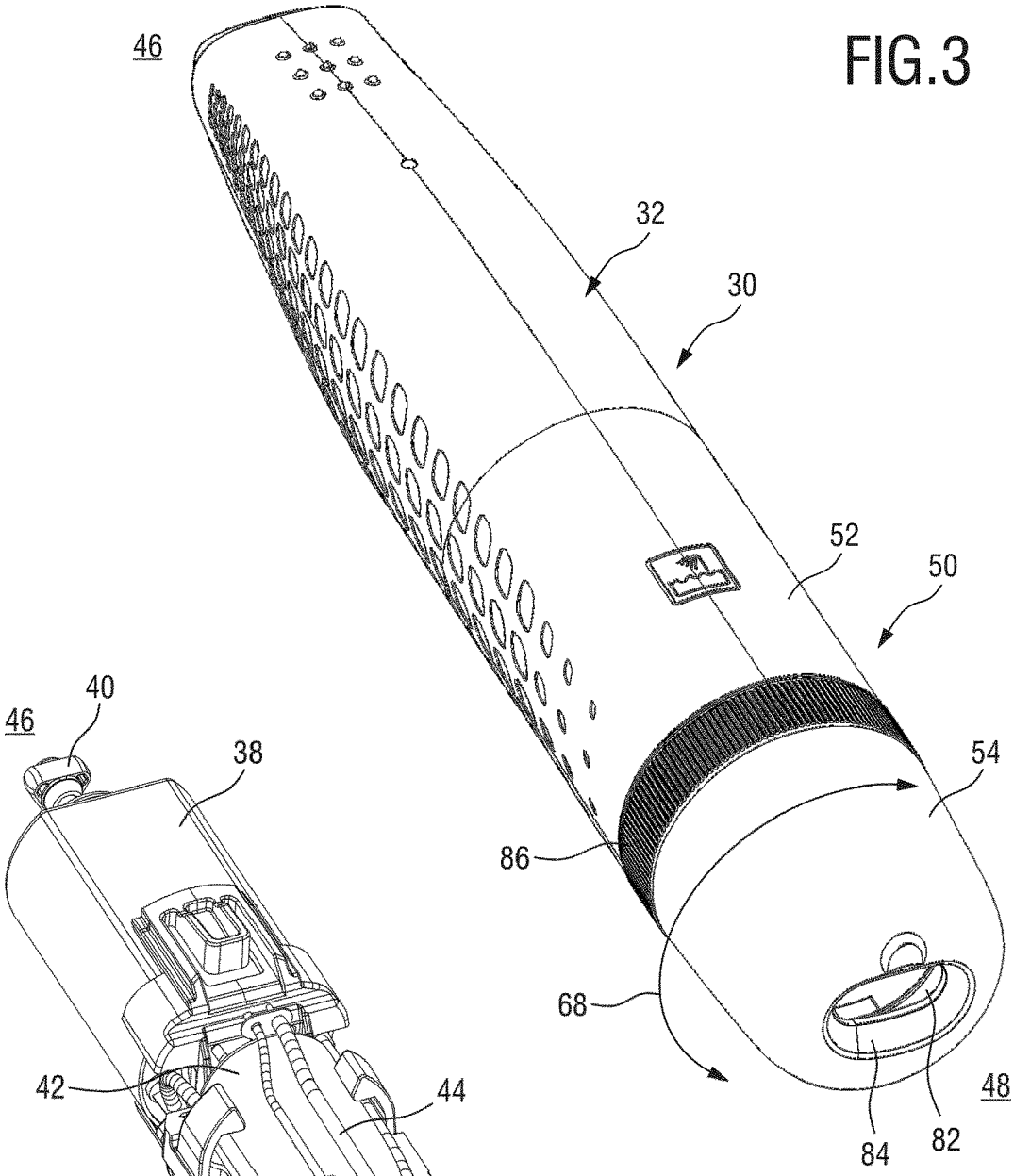
FIG. 3 shows a perspective bottom view of a housing for a grooming appliance, wherein for illustrative purposes a grooming unit is omitted in FIG. 3.
Figure 4:
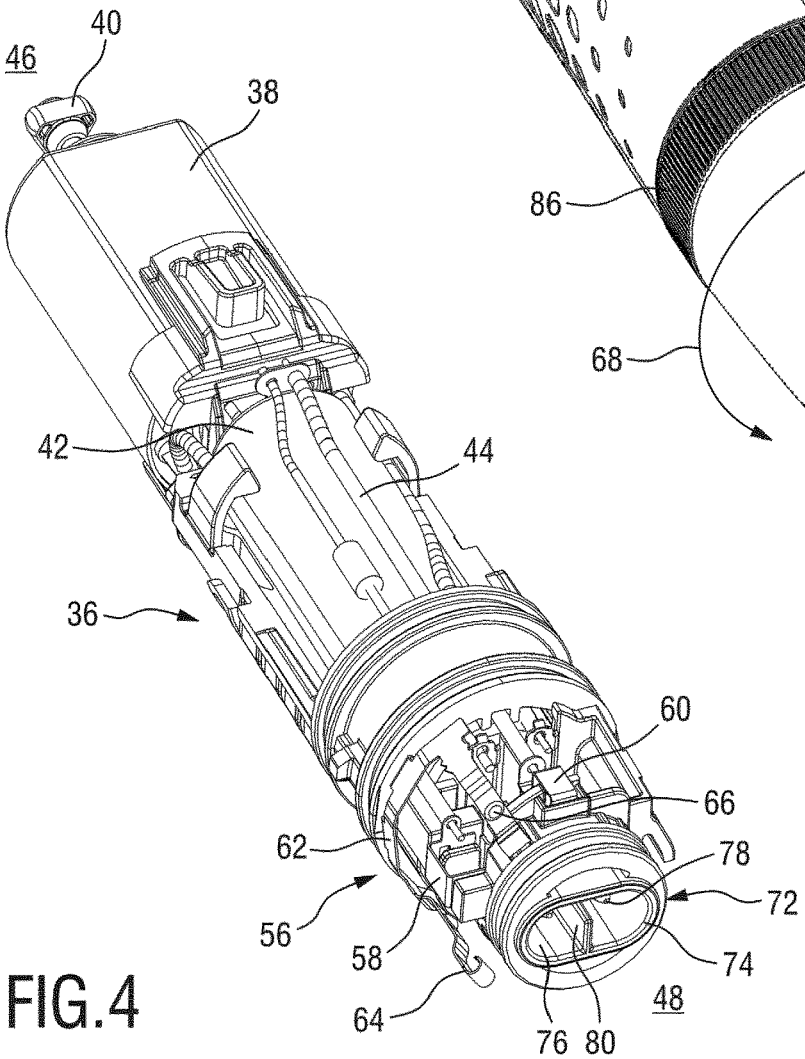
FIG. 4 shows a perspective bottom view of an interior of the hair grooming appliance the housing of which is shown in FIG. 3, wherein FIGS. 3 and 4 basically correspond to one another in orientation and scale.

With reference to FIG. 3 and FIG. 4, another exemplary embodiment of a hair grooming appliance 30 is illustrated and further described. Also the appliance 30 is arranged as a hair cutting appliance, primarily for illustrative purposes. FIG. 3 in conjunction with FIG. 4 shows an exterior contour (FIG. 3) and an interior (FIG. 4) of the appliance 30. The appliance 30 comprises a housing 32 which is arranged in a generally elongated fashion. However, as shown in FIG. 1, the housing 32 may also involve an at least partially curved shape. The housing 32 is arranged as an outer shell for the interior of the appliance which is shown in FIG. 4.

As shown in FIG. 4, the appliance 30 further comprises a support frame 36 disposed within the housing 32. This support frame 36 acts as a carrier for further components of the appliance 30. The appliance 30 further comprises a motor 38, wherein a drive shaft 40 is arranged at a top end thereof. Further, a battery unit 42 is arranged at the support frame 36. The battery unit 42 involves at least one rechargeable storage cell. Further, as indicated by reference number 44, an internal cable system is provided. In some embodiments of a personal care appliance, instead of an electric motor, an effector unit may be provided. This may for instance involve treatment heat generating units, treatment radiation generating units, light generating units, tweeze units, treatment agent dispenser units, and such like.

In FIG. 3 and in FIG. 4, a top end of the appliance 30 is indicated by reference number 46. A bottom end is indicated by reference number 48. As used herein, the top end 46 is the end of the appliance 30 which is arranged to receive the grooming or cutting unit. Consequently, the bottom end 48 is the opposite end.

The appliance 30 further comprises a safety switch arrangement 50 which may be referred to as dual purpose switch arrangement. The safety switch arrangement 50 comprises a housing portion 52 which involves components that are attached to the housing 32 or the support frame 36 such that, in a normal operation of the appliance 30, they cannot be moved with respect to the support frame 36 or, more generally, to the housing 32.

Further, an actuation portion 54 is provided which involves components of the safety switch arrangement 50 which are arranged to be moved with respect to the housing portion 52 and, consequently, with respect to at least the support frame 36 of the appliance 30. The actuation portion 54 may be actuated so as to enable a normal operation of the appliance 30 and to enable a recharging of the battery unit 42.

As can be best seen in FIG. 3, the actuation portion 54 is arranged as a bottom end extension of a main portion of the housing 32. The actuation portion 54 matches the overall shape or contour of the housing 32.

The safety switch arrangement 50 further comprises an operating switch 56 jointly defined by the actuation portion 54 and the housing portion 52. The operating switch 56 includes at least a first contact 58, 60 arranged at the housing portion 52 and at least a second contact 64, 66 arranged at the actuation portion 54. As exemplarily shown in FIG. 4, two first contacts 58, 60 and two corresponding second contacts 64, 66 may be provided.

The second contacts 64, 66 may be arranged at or form part of a contact spring 62 which is attached to the actuation portion 54 and arranged to be moved with the actuation portion 54 with respect to the housing portion 52. Consequently, the second contacts 64, 66 may be moved with respect to the first contacts 58, 60. When the second contacts 64, 66 contact their counterpart first contacts 58, 60, the contact spring 62 connects or shortcuts the first contacts 58, 60 of the operating switch 56. Consequently, the operating switch 56 is enabled and, as a result, the appliance 30 may be operated in a hair grooming mode.

As indicated in FIG. 3 by a curved double arrow designated by reference numeral 68, the actuation portion 54 and, consequently, the contact spring 62 involving the contacts 64, 66 may be rotated with respect to the housing portion 52 so as to operate the operating switch 56. As can be seen in FIG. 3 in connection with FIG. 4, the appliance 30 further comprises a power connector unit 72 which may form part of the safety switch arrangement 50. The power connector unit 72 comprises a connector receptacle 74 which may involve an insertion recess 76. The connector receptacle 74 is arranged or formed at the bottom end 48 of the support frame 36 of the appliance 30. The connector receptacle 74, by way of example, further comprises two pins 78 which are arranged in the insertion recess 76. The pins 78 may be engaged by corresponding contact sleeves of the connector plug 24 of the power adapter 20, refer to FIG. 2.

As can be further seen from FIG. 4, the connector receptacle 74 may further comprise orientation alignment elements, for instance an orientation tab 80 which defines an insertion orientation of the connector plug 24.

The actuation portion 54 at least partially covers the power connector unit 72. More particularly, the actuation portion 54 may comprise an insertion aperture 82 which may be also referred to as insertion window. The insertion aperture 82 is arranged at a bottom end 48 of the housing 32 of the appliance 30. In at least one state of operation of the safety switch arrangement 50, the insertion aperture 82 is aligned with or matches the insertion recess 76 of the connector receptacle 74. In order to engage the connector receptacle 74, the connector plug 24 has to pass through the insertion aperture 82. So as to facilitate the insertion of the connector plug 24, the actuation portion 54 may comprise an insertion aid 84 which may be for instance arranged as an insertion chamfer. The insertion aid 84 may be arranged in the vicinity of or may encompass the insertion aperture 82.

Generally, a cross-sectional extension or profile, perpendicular to a main elongation direction or an insertion direction, of the insertion aperture 82, the insertion recess 76 and the connector plug 24 may be matched. This ensures that, similar to a key lock, the connector plug 24 may engage the connector receptacle 74 exclusively in a defined relative orientation of the connector receptacle 74, the insertion aperture 82 and the connector plug 24 itself.

The actuation portion 54 further comprises a grapping section 86 which is provided with respective gripping features, for instance with gripping ribs, a gripping knurling, etc. Via the gripping section 86, a user may actuate the actuation portion 54 which may involve a twisting or rotation of the actuation portion 54 with respect to the housing portion 52.

Figure 5:
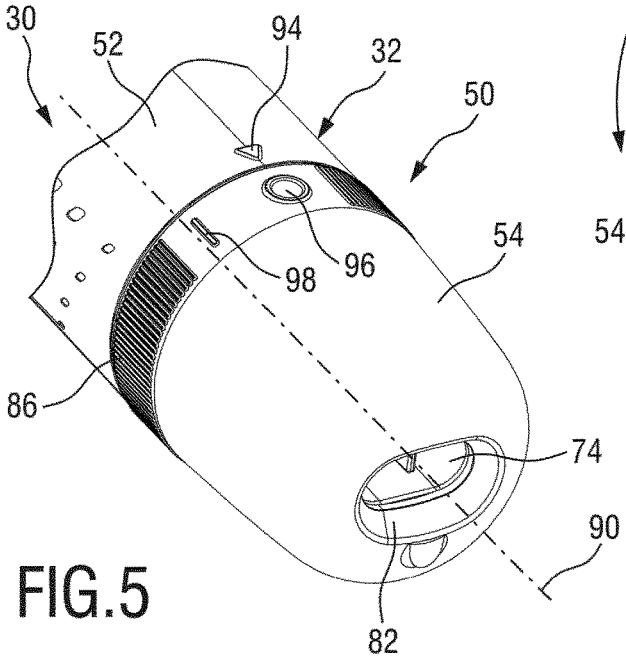
FIG. 5 is a partial perspective bottom view of the arrangement of FIGS. 3 and 4, in a second state of an actuation portion.
Figure 6:
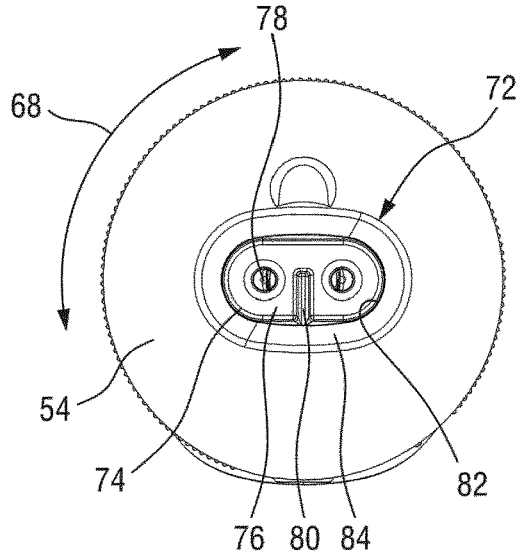
FIG. 6 shows a corresponding bottom view of the arrangement of FIG. 5.
Figure 7:
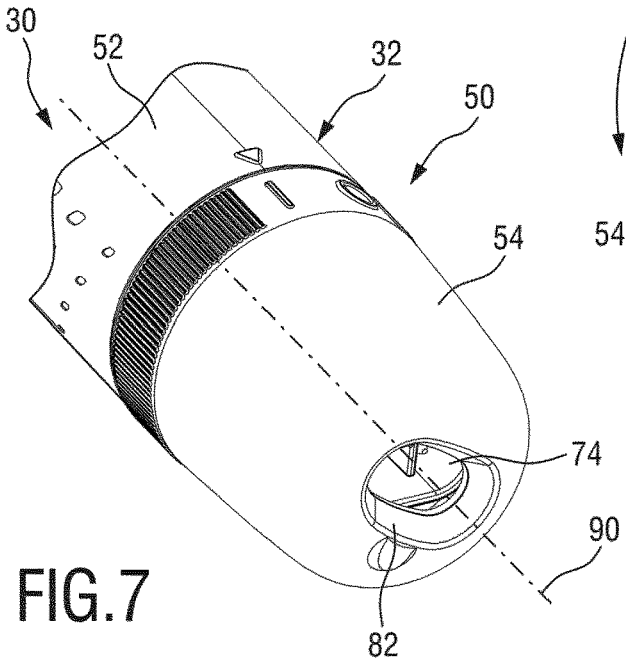
FIG. 7 is a partial perspective bottom view corresponding to the view of FIG. 5, wherein the actuation portion is shown in first a state.
Figure 8:
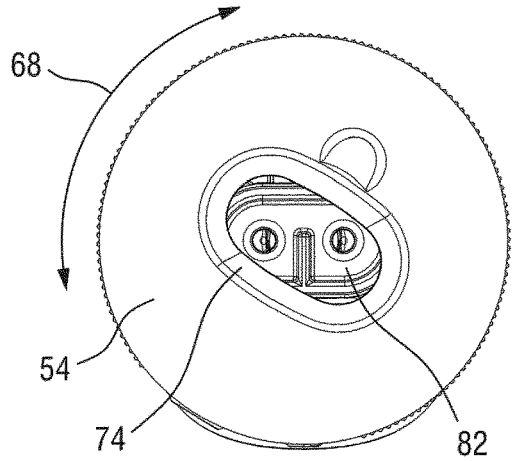
FIG. 8 shows a corresponding bottom view of the arrangement of FIG. 7.

With particular reference to FIGS. 5 to 8, a mode of operation of the safety switch arrangement 50 is described and further detailed. FIG. 5 and the corresponding bottom view of FIG. 6 illustrate a second state of operation of the safety switch arrangement 50. FIG. 7 and the corresponding bottom view of FIG. 8 illustrate and a first state of operation of the safety switch arrangement 50.

In the second state of operation as shown in FIG. 5 and FIG. 6, the actuation portion 54 is in a second relative orientation with respect to the housing portion 52. By contrast, in the first state of operation as shown in FIG. 7 and FIG. 8, the actuation portion 54 is in a first relative position or orientation with respect to the housing portion 52.

As used herein, the terms first state and second state shall not be interpreted in a limiting sense. Rather, the terms first state and second state are primarily provided for illustrative purposes. The indication first or second state is basically exchangeable without affecting the scope of the disclosure. Further, the indication first or second state is in no way associated with a qualitative or quantitative evaluation.

In some exemplary embodiments, the second state as illustrated in FIG. 5 and FIG. 6 may be referred to as power-off and recharging state. Accordingly, the first state as illustrated in FIG. 7 and FIG. 8 may be referred to as power-on and non-recharging state.

In at least some embodiments, the housing 32 of the appliance 30 defines a main elongation axis which may be referred to as longitudinal axis 90. As can be clearly seen from FIG. 5 and FIG. 7, the actuation portion 54 is arranged to be rotated about the longitudinal axis 90 with respect to the housing portion 52.

A movement range or angular dimension of the actuation movement can be derived from the illustration of the second state as shown in FIG. 5 and FIG. 6 and from the illustration of the first state as shown in FIG. 7 and FIG. 8.

Further, position references and/or position indicators may be provided so as to enable a visual indication of a current state of operation of the safety switch arrangement 50. For instance, the housing portion 52 may be provided with a position reference 94. Accordingly, the actuation portion 54 may be provided with a first position indicator 96 and a second position indicator 98. The first position indicator 96 is associated with the second state, refer to FIG. 5. The second position indicator 98 is associated with the first state, refer to FIG. 7.

A movement of the actuation portion 54 between the first state and the second state operates the operating switch 56, refer to FIGS. 3 and 4 and, at the same time, operates and defines a state of the power connector unit 72. As can be best seen in FIG. 6, in the second state of the actuation portion 54, the insertion recess 76 of the connector receptacle 74 is revealed or unlocked. The insertion aperture 82 and the connector receptacle 74 are aligned with one another. Consequently, the connector plug 24 (FIG. 2) may be inserted and may engage the power connector unit 72. Further, when the connector plug 24 is plugged in, a reverse movement of the actuation portion 54 from the second state towards the first state is prevented. Hence, it is basically impossible to activate the power-on operating state of the appliance 30.

As can be best seen from FIG. 7 and FIG. 8, in the first state of the actuation portion 54, the insertion aperture 82 and the connector receptacle 74 are considerably misaligned or misoriented with respect to one another. For instance, as the actuation portion 54 may be rotated about the longitudinal axis 90, the insertion aperture 82 may be twisted or rotated with respect to the connector receptacle 74 which prevents an insertion of the connector plug 24. Further, the operating switch 56 (FIG. 4) is actuated in the first state as shown in FIG. 7 and FIG. 8. Consequently, the appliance 30 is set into a power-on or switched-on operation mode which may involve for instance a hair cutting or hair grooming operation. It is impossible to plug in the connector plug 24 in the first state of the actuation portion 54. This greatly enhances the safety level of the appliance 30.

Figure 9:
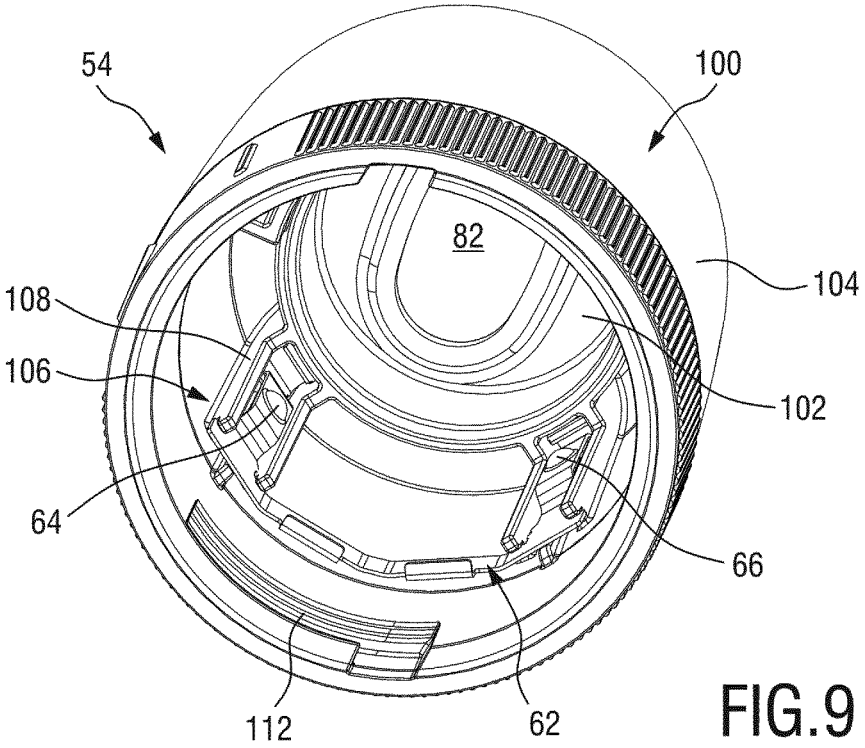
FIG. 9 shows a perspective top view of an actuation portion for a safety switch arrangement.
Figure 10:
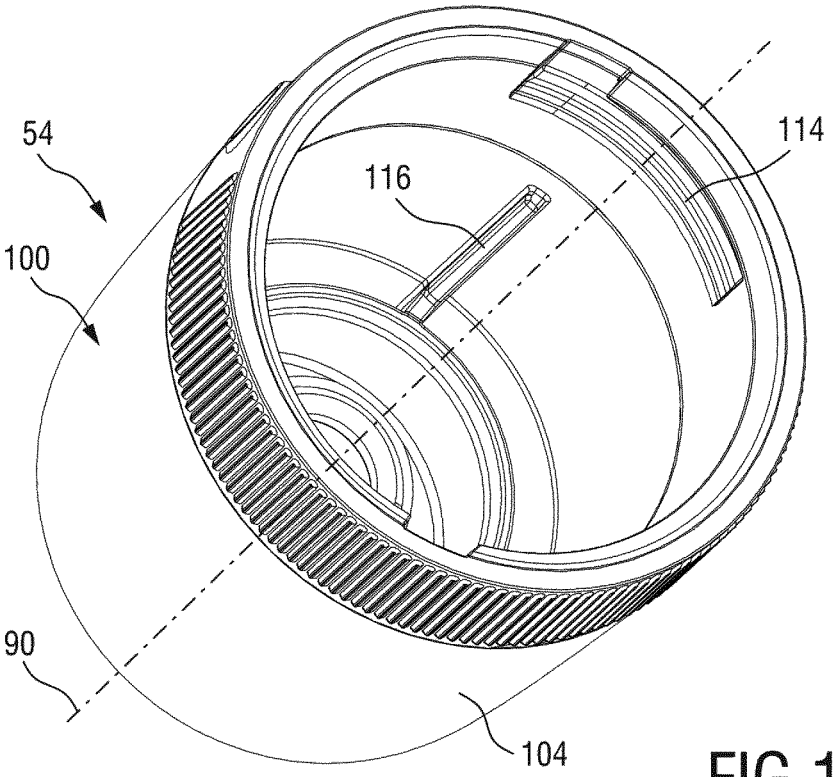
FIG. 10 shows another perspective top view of the actuation portion of FIG. 9 in a different orientation.

With reference to FIG. 9 and FIG. 10, an exemplary arrangement of an actuation portion 54 within the context of the present disclosure will be described in more detail. By way of example, the actuation portion 54 may be arranged as a cup 100 comprising a bottom wall 102 and a circumferential wall 104. In the mounted state as shown in FIG. 5 and FIG. 7, the bottom wall 102 defines the bottom end 48 of the appliance 30. An opening at a frontal end of the circumferential wall 104 contacts the housing portion 52. Generally, the actuation portion 54 may be arranged as a cup, a cylinder having a bottom wall, a segment of an ellipsoid, and in a similar fashion. In an exemplary embodiment, the actuation portion 54 is arranged in a basically rotationally symmetric fashion with respect to the longitudinal axis 90.

At an interior of the circumferential wall 104, the contact spring 62 is arranged. Mounting features 106 involving tabs 108, recesses, snap-on and/or click-on features may be present at the actuation portion 54 so as to enable a defined snap-on or click-on mounting of the contact spring 62.

As can be best seen from FIG. 9, the second contacts 64, 66 are respectively arranged between tabs 108. Further, the contacts 64, 66 are arranged at an angular offset from one another with respect to the longitudinal axis. Further, the contacts 64, 66 are arranged at an axial offset from one another. Generally, the contact spring 62 is arranged in a U-shaped fashion comprising a base portion and two legs extending from the base portion, wherein the contacts 64, 66 are arranged at respective ends of the legs.

As can be further seen from FIG. 9, the contact spring 62 may be inserted in the mounting features 106 of the actuation portion 64 wherein an insertion direction is basically parallel to the longitudinal direction and involves a movement from the top end 46 to the bottom end 48 (FIG. 4).

At the actuation portion 54, mounting recesses 112, 114 are provided. Preferably, the mounting recesses 112, 114 are arranged at or adjacent to a top end of the circumferential wall 104. For instance, two opposite mounting recesses 112, 114 are provided which are distributed at the circumferential extension of the circumferential wall 104. For instance, an offset angle of the first mounting recess 112 (FIG. 9) and a second mounting recess 14 (FIG. 10) may be at about 180° (degree). In other words, at least in some embodiments, the first mounting recess 112 and the second mounting recess 114 may be arranged in a point-symmetric fashion with respect to the longitudinal axis 90. However, also alternative embodiments may be envisaged involving a non-point-symmetric arrangement thereof at the perimeter of the circumferential wall 104.

The mounting recesses 112, 114 may be also referred to as bayonet recesses. The recesses 112, 114 have a basically L-shaped extension. The recesses 112, 114 comprise a first leg defining an insertion portion facing the top end of the circumferential wall 104. Further, a second leg is provided which extends in the circumferential extension and is therefore basically perpendicular to the insertion portion. The circumferentially extending portion may be also referred to as twisting or rotation portion.

As can be further seen from FIG. 10, an abutment rib 116 may be provided at the circumferential wall 104. The rib 116 basically extends in a fashion parallel to the longitudinal axis 90. The recesses 110, 114 and the rib 116 may corporate so as to enable a defined mounting of the actuation portion 54 at the housing portion 52 and a defined movement or twisting range of the actuation portion 54 with respect to the housing portion 52 which will be further discussed and detailed with reference to FIGS. 11 to 15.

Figure 13:
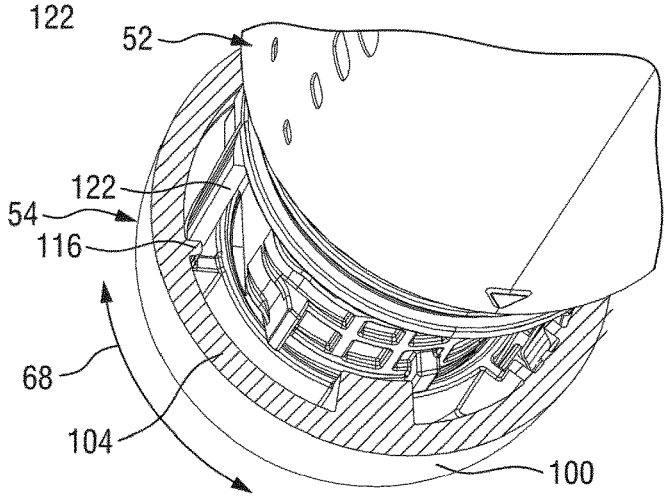
FIG. 13 shows a partial perspective top view of a safety switch arrangement comprising a housing portion and an actuation portion, wherein the actuation portion is shown in a cross sectional state for illustrative purposes in FIG. 13.
Figure 14:
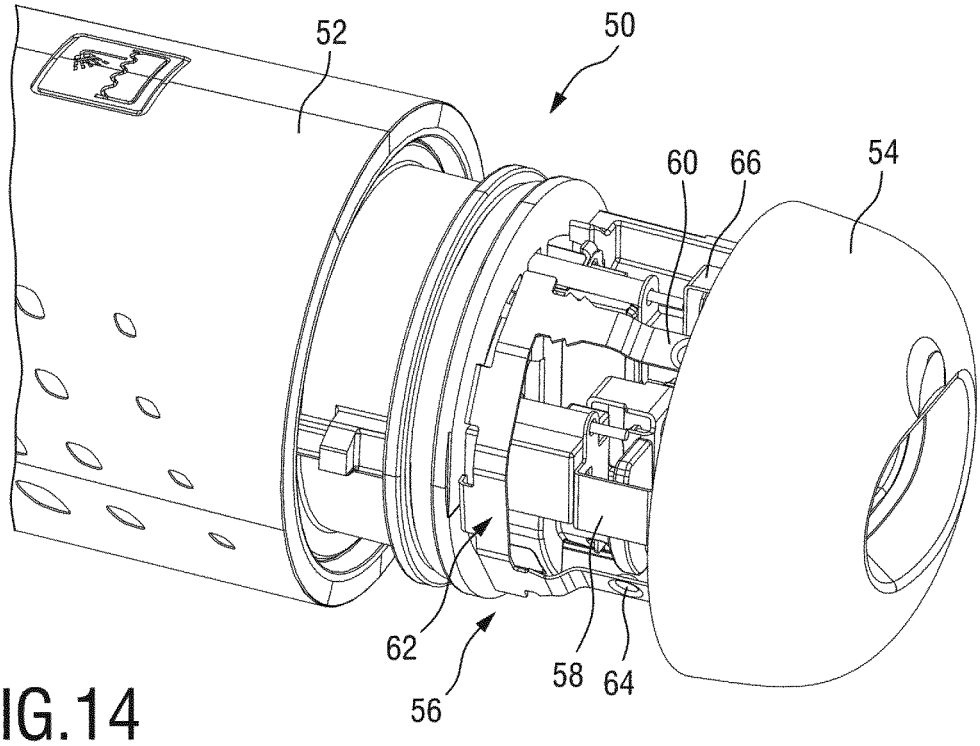
FIG. 14 shows a perspective bottom view of the safety switch arrangement of FIG. 13, the actuation portion shown in the second state, wherein the actuation portion is partially omitted for illustrative purposes.
Figure 15:
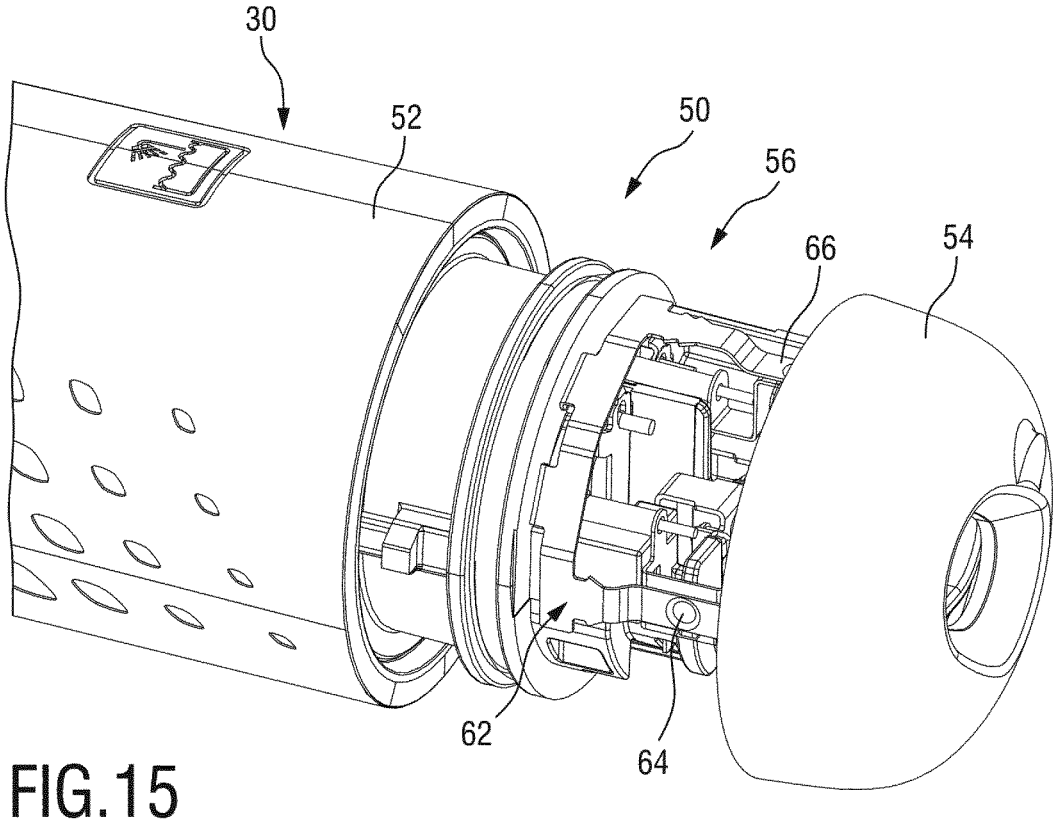
FIG. 15 shows another perspective top view in accordance with the arrangement of FIG. 14, wherein the actuation portion is shown in the first state.

In FIG. 13, and also in FIG. 14 and FIG. 15, a portion of the circumferential wall 104 of the actuation portion 54 is cut out and omitted for illustrative purposes so as to provide an internal view of the safety switch arrangement 50.

Figure 11:
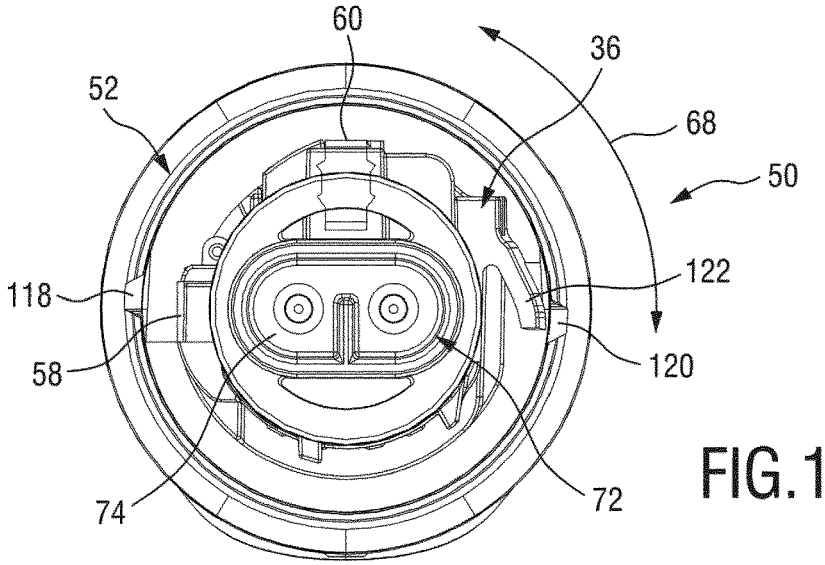
FIG. 11 shows a bottom view of a housing portion of a safety switch arrangement.
Figure 12:
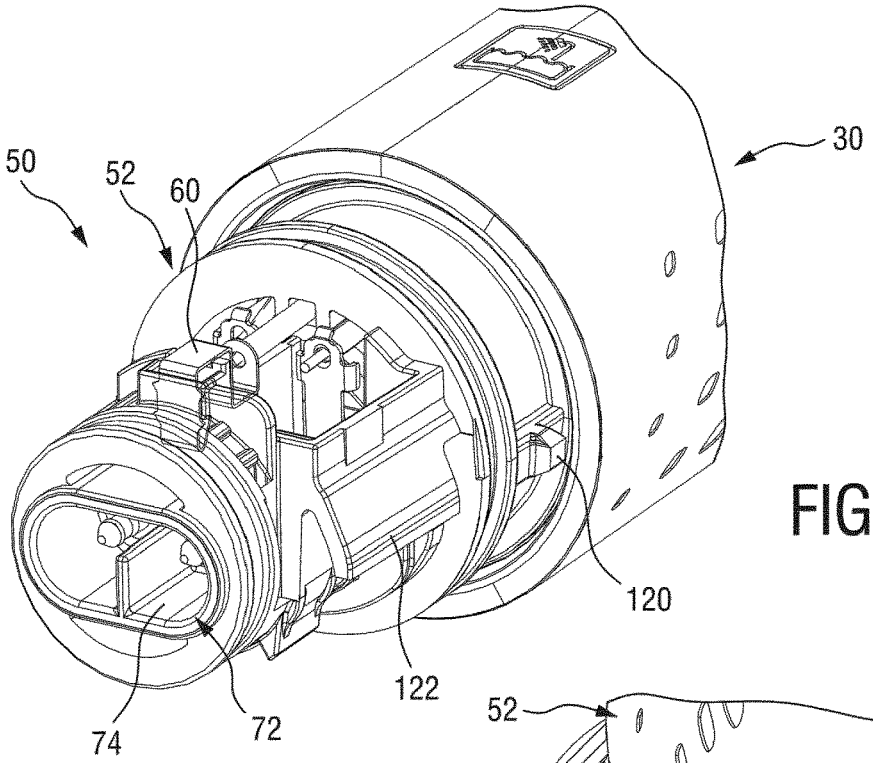
FIG. 12 shows a perspective bottom view of the arrangement of FIG. 11.

FIG. 11 and FIG. 12 illustrate a state of the appliance 30 where the actuation portion 54 is detached from the housing portion 52. In other words, the actuation portion 54 as shown in FIG. 9 and FIG. 10 may be mounted to the housing portion 52 as shown in FIG. 11 and FIG. 12.

At the support frame 36, radial protrusions 118, 120 are arranged which are formed in a radially protruding fashion. The radial protrusion 118 is arranged to engage the recess 112. The radial protrusion 120 is arranged to engage the recess 114. Consequently, a bayonet mounting of the actuation portion 54 is enabled. So as to secure and lock the mounted state of the actuation portion, a deflectable tab 122 is arranged at the support frame 36. The deflectable tab 122 comprises a deflectable profile and basically extends in the longitudinal direction. The deflectable tab 122 is arranged to cooperate with the rib 116 of the actuation portion 54, refer also to FIG. 10. As can best seen in FIG. 13, the deflectable tab 122 is arranged as a limit stop defining a maximum relative rotation between the actuation portion 54 and the housing portion 52 in a first direction when the rib 116 abuts against the tab 122. In the exemplary orientation of the view of FIG. 13, the tab 122 prevents a further clockwise rotation of the actuation portion 54 beyond the limit set by the tab 122.

In a mounting orientation, the mounting recesses 112, 114 may engage the radial protrusions 118 which enables an approach of the actuation portion 54 towards the housing portion 52 so as to assume a defined mounting orientation. The radial protrusions 118 are guided in the mounting recesses 112, 114. First, the protrusions 118, 120 are moved along the insertion portions of the recesses 112, 114 in the axial direction. A this state of the mounting procedure, a relative mounting movement of the actuation portion 54 and the housing portion 52 involves an axial displacement. At a further, second stage of the mounting procedure, the mounting movement involves a relative rotation or twisting between the actuation portion 54 and the housing portion 52. At this stage, the protrusions 118, 120 are guided at and moved along the circumferentially extending portions of the recesses 112, 114.

The mounting procedure in accordance with this embodiment involves that the rib 116 passes the deflectable tab 122 which induces a considerable deflection thereof. Having passed a dead-point, the deflectable tab 122 flexes back and therefore locks the mounted state of the actuation portion 54. In the exemplary embodiment and orientation of the view of FIG. 11, the rotation stage of the mounting procedure involves a clockwise rotation of the actuation portion (not shown in FIG. 11) with respect to the housing portion 52.

In the mounted state of the safety switch arrangement 50, a first end and a second end of the allowed rotation range or twisting range are defined by the deflectable tab 122 as shown in FIG. 13 and by an end of the circumferentially extending portion of the recesses 112, 114 that is opposite to the insertion portion.

The recesses 112, 114, the corresponding protrusions 118, 120, the rib 116 and the corresponding tab 122 define a mounting and limit stop arrangement for the safety switch arrangement 50.

Further reference is made to FIG. 14 and FIG. 15. FIG. 14 is a perspective bottom view of the safety switch arrangement 50 in the second state which is also illustrated in FIG. 5 and FIG. 6. Similarly, the perspective bottom view of the safety switch arrangement 50 of FIG. 15 illustrates a first state of the safety switch arrangement 50 which is also shown in FIG. 7 and FIG. 8.

As already indicated above, in FIG. 14 and FIG. 15, a portion of the actuation portion 54 is omitted for illustrative purposes. In the second state view of FIG. 14, the second contacts 64, 66 of the contact spring 62 are spaced away from their counterpart contacts 58, 60 at the housing portion 52. By contrast, in the first state as illustrated in FIG. 15, the second contacts 64, 66 engage or contact their counterpart first contacts 58, 60. Consequently, in the state as shown in FIG. 15 an operation of the appliance 30 is enabled.

In further exemplary embodiments, resting features are provided so as to maintain the safety switch arrangement 50 in the first state or the second state. The safety features may involve flexible or spring elements. Hence, a holding force may be generated in the first state and the second state, respectively, so as to define and maintain the two distinct states of operation and to prevent an unintentional switching or twisting of the safety switch arrangement 50.

Figure 18:
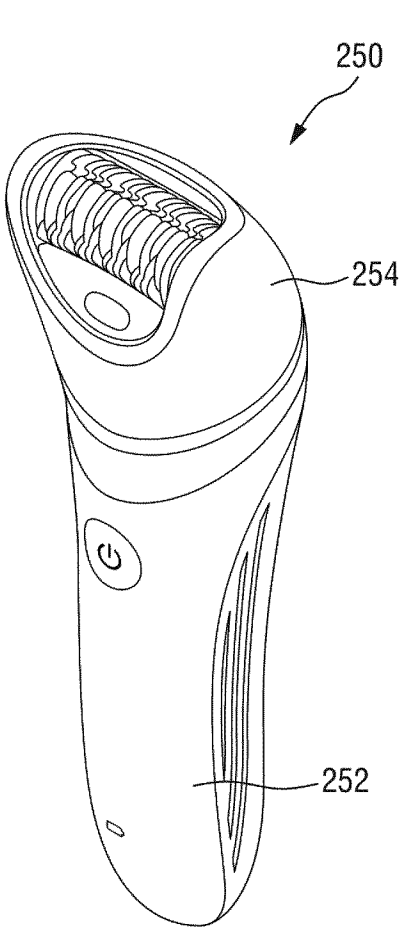
FIG. 18 shows a perspective view of a personal care appliance arranged as a hair removal appliance, particularly as an epilator.
Figure 17:
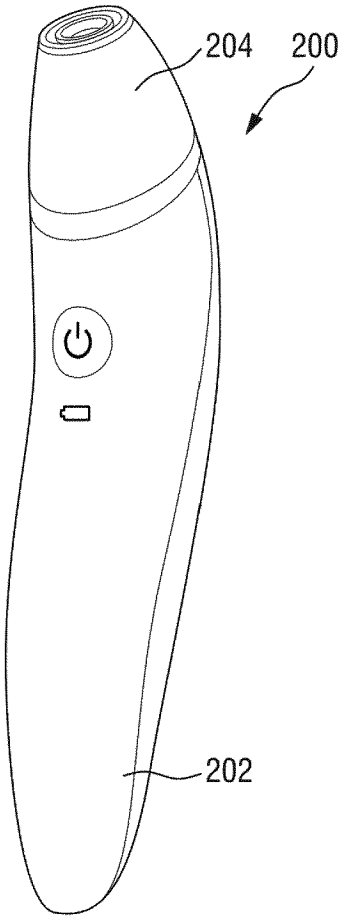
FIG. 17 shows a perspective view of a personal care appliance arranged as a skin treatment appliance.
Figure 16:
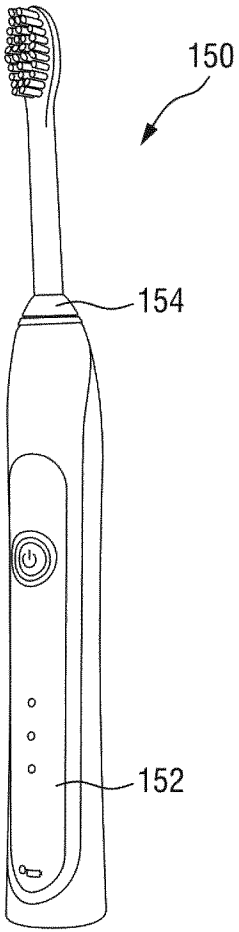
FIG. 16 shows a perspective view of a personal care appliance arranged as an electric toothbrush.

Reference is made to FIGS. 16, 17 and 18, illustrating further embodiments of battery powered rechargeable personal care appliances within the context of the present disclosure.

FIG. 16 shows a perspective view of a personal care appliance 150 arranged as an electric toothbrush. The appliance 150 comprises a housing 152 and a treatment unit 154 comprising a detachable brush. FIG. 17 shows a perspective view of a personal care appliance 200 arranged as a skin treatment appliance. The appliance 200 comprises a housing 202 and a treatment unit 204 comprising exfoliation features and massage features, for instance. FIG. 18 shows a perspective view of a personal care appliance 250 arranged as a hair removal appliance, particularly as an epilator. The appliance 250 comprises a housing 252 and a treatment unit 254 comprising hair removal features, for instance a tweeze unit.

Also these and other types of personal care devices may profit from a safety switch arrangement in accordance with the present disclosure.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A safety switch arrangement for a power connector of a personal care appliance, the arrangement comprising:

a housing portion;

a power connector having an insertion recess and a connector receptacle within the insertion recess;

an operating switch; and an actuation portion, wherein the actuation portion is mounted to the housing portion and arranged to be moved between a first state and a second state, wherein the power connector is arranged at the housing portion, wherein the actuation portion, in the first state, enables an operation of the personal care appliance and prevents a contact with the connector receptacle, wherein the operating switch is switched on by the actuation portion in the first state, and wherein the actuation portion, in the second state, prevents an operation of the personal care appliance and is oriented to fully expose the insertion recess to enable the contact with the connector receptacle.

2. The safety switch arrangement as claimed in claim 1, wherein the actuation portion is secured in the second state when a connector plug engages the connector receptacle.

3. The safety switch arrangement as claimed in claim 1, wherein a first contact element of the operating switch is attached to the housing portion, wherein a second contact element of the operating switch is attached to the actuation portion, wherein, in the first state of the actuation portion, the first contact element and the second contact element contact one another, and wherein, in the second state of the actuation portion, the first contact element and the second contact element are spaced away from one another.

4. The safety switch arrangement as claimed in claim 3, wherein the second contact element forms part of a contact spring.

5. The safety switch arrangement as claimed in claim 3, wherein the second contact element forms part of a contact spring which is arranged at a circumferential wall of the actuation portion.

6. The safety switch arrangement as claimed in claim 1, wherein the actuation portion locks the connector receptacle in the first state, and wherein the actuation portion unlocks the connector receptacle in the second state.

7. The safety switch arrangement as claimed in claim 1, wherein the actuation portion blocks an access for a connector plug to the connector receptacle in the first state, and wherein the actuation portion enables the access for the connector plug to the connector receptacle in the second state.

8. The safety switch arrangement as claimed in claim 1, wherein the actuation portion is arranged as an extension of the housing portion, and wherein the actuation portion is arranged at a bottom end of the housing portion that is opposite to a top end which is arranged to receive a grooming unit.

9. The safety switch arrangement as claimed in claim 1, wherein the actuation portion comprises a circumferential extension substantially corresponding to a circumferential extension of the housing portion, at least in a contact area where the actuation portion and the housing portion contact one another.

10. The safety switch arrangement as claimed in claim 1, wherein the actuation portion is provided with a gripping section comprising gripping features for handling and operating the actuation portion between the first state and the second state.

11. The safety switch arrangement as claimed in claim 1, wherein the housing portion and the actuation portion comprise mounting features that enable a positive fit mounting, preferably a twist-lock mounting, of the actuation portion at the housing portion, wherein the mounting features cooperate so as to define limit stops for relative movement between the actuation portion and the housing portion.

12. A personal care appliance comprising a housing arranged to receive a treatment unit, a motor, disposed within the housing and a safety switch arrangement as claimed in claim 1, wherein, in the first state of the actuation portion, the appliance is operable for personal care treatment, and wherein, in the second state of the actuation portion, a personal care treatment operation of the appliance is prevented.

13. The personal care appliance as claimed in claim 12, further comprising a battery configured to be recharged via the connector receptacle, wherein a treatment state of operation and a recharge state of operation are mutually exclusive, depending on an actual state of the actuation portion.

14. The personal care as claimed in claim 12, wherein the power connector is configured to be coupled with a power adapter, the power adapter comprising a connector plug configured to engage the connector receptacle exclusively in the second state of the actuation portion, and wherein the appliance is configured to operate in a wet or moist environment.

15. The safety switch arrangement as claimed in claim 1, wherein the actuation portion is arranged as an extension of the housing portion.

16. The safety switch arrangement as claimed in claim 1, wherein the actuation portion comprises a circumferential extension substantially corresponding to a circumferential extension of the housing portion.

17. The safety switch arrangement as claimed in claim 1, wherein the housing portion and the actuation portion comprise a twist-lock mounting that enables a positive fit mounting of the actuation portion at the housing portion.

18. The safety switch arrangement as claimed in claim 17, wherein the twist-lock mounting cooperates so as to define limit stops for relative movement between the actuation portion and the housing portion.

19. A safety switch arrangement for a power connector of a personal care appliance, the arrangement comprising:

a housing portion;

a power connector comprising a connector receptacle;

an operating switch; and an actuation portion, wherein the actuation portion is mounted to the housing portion and arranged to be moved between a first state and a second state, wherein the power connector is arranged at the housing portion, wherein the actuation portion, in the first state, enables an operation of the personal care appliance and prevents a contact with the connector receptacle, wherein the operating switch is switched on by the actuation portion in the first state, wherein the actuation portion, in the second state, prevents an operation of the personal care appliance and enables a contact with the connector receptacle, and wherein the actuation portion is arranged to be rotated with respect to the housing portion about a longitudinal axis thereof, between the first state and the second state.

20. A safety switch arrangement for a power connector of a personal care appliance, the arrangement comprising:

a housing portion;

a power connector comprising a connector receptacle;

an operating switch; and an actuation portion, wherein the actuation portion is mounted to the housing portion and arranged to be moved between a first state and a second state, wherein the power connector is arranged at the housing portion, wherein the actuation portion, in the first state, enables an operation of the personal care appliance and prevents a contact with the connector receptacle, wherein the operating switch is switched on by the actuation portion in the first state, wherein the actuation portion, in the second state, prevents an operation of the personal care appliance and enables a contact with the connector receptacle, and wherein the actuation portion is arranged in a cup-like fashion, wherein an open end thereof faces the housing portion, wherein a bottom wall thereof faces away from the housing portion, wherein an insertion aperture is formed in the bottom wall, and wherein the insertion aperture defines an opening which is aligned with the connector receptacle in the second state of the actuation portion and which is misoriented with respect to the connector receptacle in the first state of the actuation portion.

* * * * *